US005231307A

United States Patent [19]

Yumiyama et al.

[11] Patent Number: 5,231,307

[45] Date of Patent: Jul. 27, 1993

[54] STARTER FOR STARTING INTERNAL COMBUSTION ENGINE

[75] Inventors: Shigeru Yumiyama, Katsuta; Shigeo Hosaka, Hitachi, both of Japan

[73] Assignee: Hitachi, Ltd., Tokyo, Japan

[21] Appl. No.: 830,846

[22] Filed: Feb. 4, 1992

[30] Foreign Application Priority Data

Feb. 4, 1991 [JP] Japan ..... 3-13234

[51] Int. Cl.[5] ..... F02N 15/02; F02N 15/00

[52] U.S. Cl. ..... 290/48; 74/5; 74/7 R; 74/7 E; 74/DIG. 10; 290/38 R; 290/38 C

[58] Field of Search ..... 74/6, 7 R, 7 E, 6, 7 R, 74/DIG. 10; 290/38 R, 48, 38 C

[56] References Cited

U.S. PATENT DOCUMENTS 3,663,825 5/1972 Bowcott ..... 290/48
4,651,575 3/1987 Morishita et al. ..... 74/7 E
4,918,324 4/1990 Isogumi ..... 290/48

FOREIGN PATENT DOCUMENTS 164565 7/1991 Japan .

*Primary Examiner*—A. D. Pellinen
*Assistant Examiner*—Robert Lloyd Hoover
*Attorney, Agent, or Firm*—Antonelli, Terry, Stout & Kraus

[57] ABSTRACT

A starter for an internal combustion engine including mechanical components subject to an impact load during operation including a shift lever, internal gear, gear cover formed integrally with the internal gear, front case, center bracket, and brush holder disposed in a rear bracket. At least one of the mechanical components is formed of a synthetic resin having a glass transition temperature greater than 90° C. such as an aromatic copolymer and nylon series, whereby a workability and an impact load absorbing capacity of the mechanical components as well as the bending rupture strength are capable of withstanding an impact load caused by an abnormal operation of the starter at a high environmental temperature greater than 150° C.

2 Claims, 1 Drawing Sheet

STARTER FOR STARTING INTERNAL COMBUSTION ENGINE

FIELD OF THE INVENTION

The present invention relates to a starter for an internal combustion engine and, more particularly, relates to a starter material for mechanical components of the starter.

BACKGROUND OF THE INVENTION

In starters of the aforementioned type, synthetic resin materials have been used for several components which are subjected to impact loads in order to improve workability of the components and to absorb the impact loads caused during engagement between a pinion of the starter and a ring gear of the engine.

In, for example, JP(U)-B-2-7263, a starter for an internal combustion engine is proposed wherein an internal gear in the planetary gear is fashioned of a synthetic resin.

When the mechanical components of such starters, made of a synthetic resin, are subjected to a high temperature above a glass transition temperature of the synthetic resin, the mechanical strength of the synthetic resin is extremely reduced in comparison with subjecting the same to a low temperature. Starters for internal combustion engines are used in a temperature range of about −40° C. to about 150° C. Consequently, materials capable of withstanding the impact load caused during the operation of the starters, in particular, during the operation under elevated temperature conditions, must be used for the mechanical components of the starters.

However, the selected synthetic resins form mechanical components of the starters have been based upon an elastic modulus of the material, and no attention has been given to a relationship between a glass transition temperature of the synthetic resin materials and their mechanical strength during the operation of the starters.

For example, synthetic resin materials having a glass transition temperature of about 60° C. have been used for the mechanical components of the starter, with no significant problems arising during a normal operating condition of the starter even at a high ambient temperature of an engine compartment of 150° C., which ambient temperature occurs immediately after the engine is stopped, after, for example, a driving at a high speed under a high ambient temperature of greater than 50° C. However, a problem does arise in that the mechanical components fashioned of such a synthetic resin were prone to damage due to an impact load when the high temperature condition was followed by an abnormal operating condition of the starter wherein an excessive impact load was caused by an abnormal engagement of the pinion and the ring gear due to, for example, an irregular key switch handling and an excessively early ignition.

SUMMARY OF THE INVENTION

The aim underlying the present invention essentially resides in providing a starter having mechanical components which avoids, by simple means, the problems encountered in the prior art.

In accordance with the present invention, a starter for an internal combustion engine is provided wherein the mechanical components have a high workability, a high impact absorbing capacity, and a high mechanical strength which is achieved by increasing an impact load withstanding property or rupture strength thereof, thereby preventing a rupture of the mechanical components even when the starter is operated in an abnormal way at a high temperature condition.

It has been experimentally determined by the present inventors that the mechanical parts of a starter, under a series occurrence of severe operating conditions, such as, for example, high temperature conditions and abnormal operating conditions, when fashion of synthetic resin materials having a glass transition temperature of greater than 90° C., satisfactorily meet the requirements for the mechanical components of the starter preferably made of synthetic resins.

Synthetic resin materials have a low elastic modulus in comparison with metallic materials such that synthetic materials can absorb the impact load during engagement of the pinion and ring gear of the starter and the engine. Specific mechanical components of the starter preferably made of synthetic resins and subjected to the impact load generated during engagement between the pinion and the ring gear include a front case rotatably supporting one end of the pinion shaft through a bearing, a center bracket rotatably supporting the other end of the pinion shaft through a bearing, a rear bracket, a brush holder disposed in the rear bracket, a shift lever for shifting the pinion in an axial direction of the pinion shaft into engagement with the engine ring gear, an internal gear and a planetary gear reduction mechanism for transmitting the drive power of a motor to the pinion, and a gear cover formed integrally with the internal gear.

The impact load withstanding strength of the mechanical components of the starter made of a synthetic resin is generally reduced in dependence upon a temperature increase due to the physical nature of the synthetic resin; however, when the mechanical parts are made of a synthetic resin having a glass transition temperature of greater than 90° C., it has been experimentally proven that the mechanical components maintain an impact load capable of withstanding an excessive impact force caused by an abnormal operation even in an environment of a high engine temperature of about 150° C.

According to the present invention, mechanical components of the starter made of synthetic resin materials are formed with synthetic resin materials having a glass transition temperature of greater than 90° C., whereby an excellent starter is provided which maintains a soundness of the starter even when the starter is abnormally operated under an extremely severe high temperature condition, improves the workability of the mechanical components, increases the impact absorbing property and fulfills the requirements of high temperature resistance and impact resistance.

DETAILED DESCRIPTION

Figure 1:
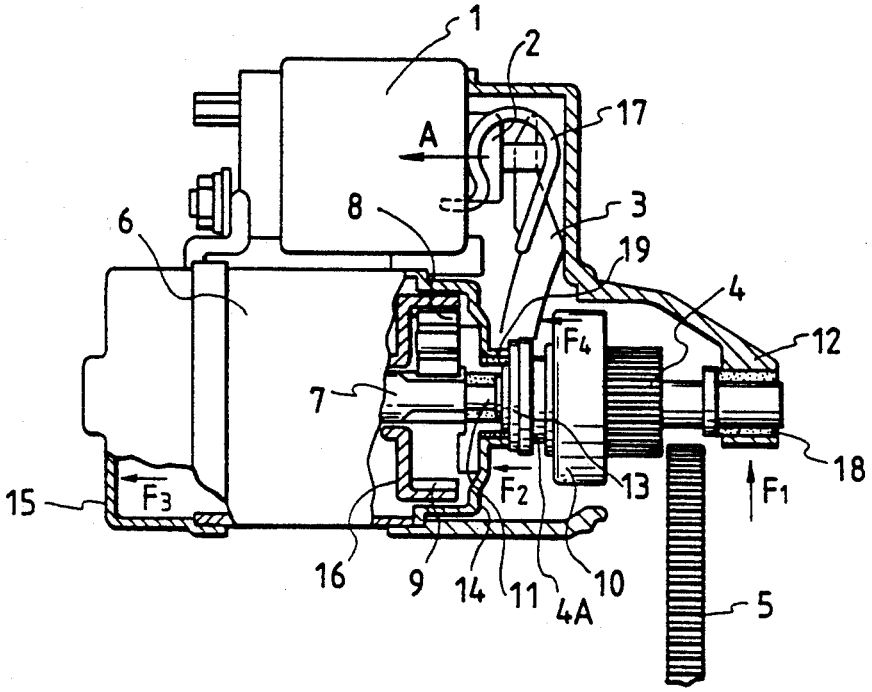
FIG. 1 is a partial cross-sectional view of one embodiment of a starter for starting an internal combustion engine according to the present invention.

Referring now to the drawings wherein like reference numerals are used throughout the various views to designate like parts and, more particularly, to FIG. 1, according to this figure, an electromagnetically actuated starter includes, for example, a plunger 2 of an electromagnetic switch coupled with a pinion sleeve 4A through a shift lever 3 and a torsion spring 17. The pinion sleeve 4A includes an over running clutch 10 and a pinion 4 and is fitted, through a helical spline, to a pinion shaft 11 forming an output of a planetary gear reduction mechanism and being reciprocally mounted for movement in an axial direction.

One end of the pinion shaft 11 is supported on a front casing 12 of the starter through a bearing 18 and the other end thereof is supported on a center bracket 14 through a bearing 19.

A E-ring 13 restricts the movement of the pinion sleeve 4A, with a rear bracket 15 forming a rear main body of the starter, and with the rear bracket 15 including a brush holder (not shown) for a motor 6.

The planetary gear reduction mechanism includes a sun gear on the rotary shaft of the motor 6, a planetary gear 8 and an internal gear 9, with the planetary gear reduction mechanism being covered by a gear cover 16 integrally formed with the internal gear 9.

When a key switch (not shown) is turned on, the solenoid of the magnetic switch of the starter is energized and the plunger 2 is attracted in the direction of the arrow A, with the shift lever 3 rotating in a direction against the spring force of the torsion spring 17 and the pinion 4 is displaced into meshing engagement with the ring gear 5 on the engine.

Built-in contacts in the magnetic switch 1 are made by the movement of the plunger 2, whereby the motor 6 generates a torque within the generated torque being transmitted to the clutch 10 through the pinion shaft 11 and the helical spline and then to the pinion 4 after a rotational speed caused by the torque is reduced by the planetary gear reduction mechanism. Upon the torque transmission to the pinion 4, the ring gear 5 is rotated to start the engine.

During the starter operation, the pinion 4 and the ring gear 5 engage while impacting each other, and, due to the impact force, an engagement reaction force in the direction of the arrow $F_1$ is transmitted to the front casing 12 through the pinion shaft 11 and the front bearing 18.

Furthermore, an engagement thrust load in the direction of the arrow $F_2$ acts on the center bracket 14 through the pinion sleeve 4A, the pinion shaft 11 and E-ring 13.

Moreover, thrust loads acting in the direction of the arrows $F_3$, $F_4$ act on the rear bracket 15 which limits the axial movement of the rotating shaft of the motor 6 and on the shift lever 3.

An impact force, transmitted through the pinion 4, the clutch 10, the pinion shaft 11 and the planetary gear 8 is applied on the internal gear 9 thereby causing a bending stress in roots of the teeth of the internal gear 9.

In accordance with the present invention, the mechanical components of the starter to which the impact loads are applied, namely, the shift lever 3, the internal gear 9, the gear cover 16 formed integrally with the internal gear 9, the front casing 12, the center bracket 14, the rear bracket 15 and the brush holder (not shown) formed integrally with the rear bracket 15 are formed of synthetic resin materials having a glass transition temperature of greater than 90° C., for example, synthetic resin materials of aromatic copolymer and nylon series.

The above noted impact forces are determined by moments of inertia and torsional rigidities of the respective components of both the engines and the starter and a relative rotatably speed or energy of the starter and the engine just prior to engagement of the pinion 4 and the ring gear 5, and, when an abnormal operation of the starter such as an irregular key switch operation and an excessively early ignition occurs, the mechanical components of the starter are subjected to an excessively large impact load. On the other hand, the mechanical strength of synthetic resins is reduced and the torsional rigidities tend to soften in dependence upon an increase in ambient temperature.

Figure 2:
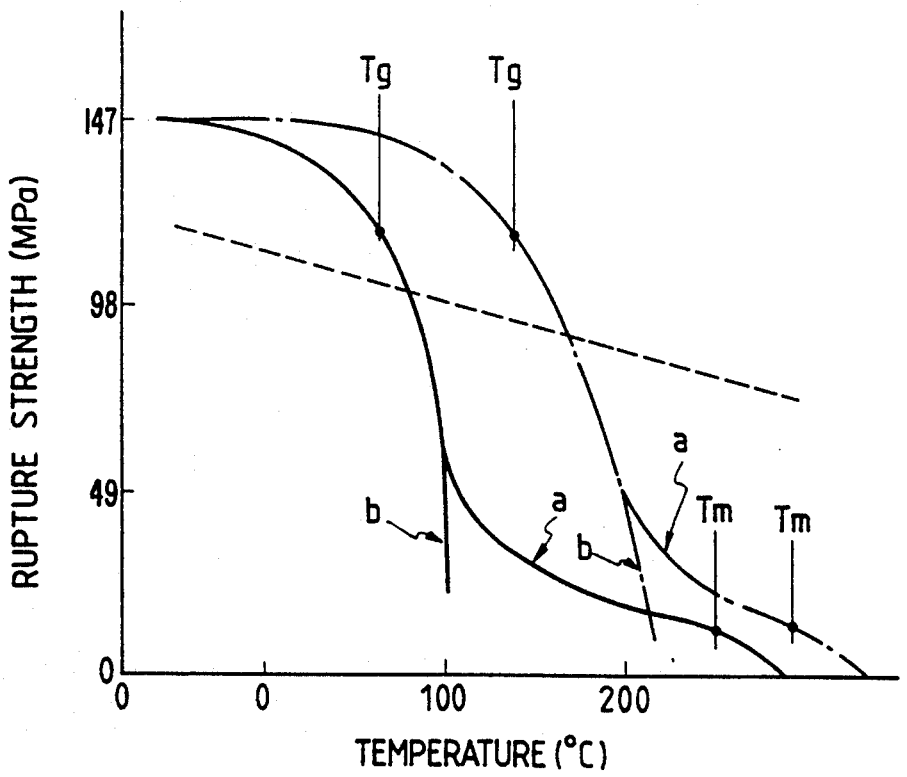
FIG. 2 is a graphical illustration of the results of experimental studies by the inventors showing the relationship between environmental temperature and rupture strength of mechanical components of a starter made of synthetic resins.

However, the mechanical components constructed in accordance with the present invention maintain a sufficient impact load withstanding strength even when the starter is operated in an abnormal manner and even at a high environmental or ambient temperature of about 150° as apparent from the graphical illustration of the experimental results shown in FIG. 2.

In FIG. 2, the abscissa represents the environmental temperature in °C. and the ordinate represents the rupture strength of the mechanical components in MPa (pascal). The dashed line in FIG. 2 represents a necessary bending strength of the internal gear 9 at the roots of the teeth thereof with respect to temperature in order to withstand the applied stress caused by an impact load. When the bending strength of the internal gear 9 at the roots of the teeth thereof is in a region above the dashed line, the internal gear 9 maintains a satisfactory bending strength even when subjected to an excessively large impact load caused by an abnormal operation of the starter. As apparent from the disposition of the dashed line, the necessary bending strength is reduced in accordance with a temperature increase, since, when the temperature increases, the internal gear 9 becomes soft thereby increasing the impact load absorbing capacity so as to reduce the necessary bending strength to sufficiently withstand the impact load applied thereto.

The solid line in FIG. 2 represents a bending rupture strength characteristic, of a synthetic resin having a glass transition temperature less than 90° C., for example, of the polyamide 66 series, with respect to environmental or ambient temperature, and the solid-dashed line in FIG. 2 represents a bending rupture strength characteristic of a synthetic resin having a glass transition temperature greater than 90° C., for example, an aromatic copolymer and nylon series. Furthermore, curved portions a in the solid and the solid-dashed lines respectively represent characteristics of crystalline synthetic resins, with the curved portions b in the solid and solid-dashed lines respectively representing characteristics of non-crystalline synthetic resins. In FIG. 2, the reference characters $T_g$ represent the glass transition temperatures of the respective synthetic resins, and the reference characters Tm represent the melting temperatures of the respective synthetic resins.

As apparent from FIG. 2, the bending rupture strength of the respective synthetic resins suddenly decreases when the environmental or ambient temperature exceeds the glass transition temperatures. Where the internal gear 9 is subjected to an impact load which exceeds the bending rupture strength at the environmental or ambient temperature of the synthetic resin of the gear the internal gear will break at impact.

As also apparent from FIG. 2, when the internal gear 9 is made of synthetic resin having a glass transition temperature $T_g$ of less than 90° C., the bending rupture strength thereof is reduced at an environmental or ambient of less than 100° C. On the other hand, when the internal gear 9 made of a synthetic resin having a glass transition temperature $T_g$ of greater than 90° C., the bending rupture strength thereof defines a necessary critical rupture strength even when the environmental temperature exceeds 150° C.

While the bending rupture strength of the internal gear 9 made of a synthetic resin having a glass transition temperature $T_g$ greater than 90° C. has been described above, as readily apparent, the same results are applicable to other mechanical components of the starter made of a synthetic resin having a glass transition temperature $T_g$ of greater than 90° C.

According to the present invention, the mechanical components of the starter such as the shift lever 3, internal gear 9, gear cover 16, front case 12, center bracket 14, rear bracket 15 and brush holder are made of a synthetic resin having a glass transition temperature $T_g$ of greater than 90° C. such that it is possible for the mechanical components of the starter to maintain their soundness even when the starter is operated in an abnormal way under a high temperature condition.

We claim:

1. An electrically driven starter for starting an internal combustion engine, the starter comprising:

an electrically driven motor;

a front case rotatably supporting one end of a pinion shaft through a first bearing;

a center bracket rotatably supporting an opposite end of the pinion shaft through a second bearing;

a rear bracket forming a rear portion of the starter;

a brush holder disposed in said rear bracket;

a shift lever adapted to shift a pinion in an axial direction of the pinion shaft so as to engage the ring gear of the internal combustion engine;

an internal gear disposed in a planetary gear reduction mechanism for transmitting a drive power of the electrically driven motor to the pinion; and a gear corner formed integrally with said internal gear, wherein at least one of said front case, center bracket, rear bracket, brush holder, shift lever, internal gear and gear cover is fashioned of a synthetic resin having a glass transition temperature greater than 90° C.

2. A starter for starting an internal combustion engine according to claim 1, wherein the synthetic resin is an aromatic copolymer and nylon series.

* * * * *